United States Patent [19]

Soules

[11] Patent Number: 4,579,077

[45] Date of Patent: Apr. 1, 1986

[54] COLLAPSIBLE ANCHOR HAVING RELEASABLE FLUKES

[76] Inventor: Jack A. Soules, 3009 Van Aken Blvd., Shaker Heights, Ohio 44120

[21] Appl. No.: 660,059

[22] Filed: Oct. 12, 1984

[51] Int. Cl.[4] ..... B63B 21/36

[52] U.S. Cl. ..... 114/301; 114/304; 114/310

[58] Field of Search ..... 114/294, 298, 301, 302, 114/303, 304, 307, 310, 219

[56] References Cited

U.S. PATENT DOCUMENTS 4,038,934 8/1977 Thomson ..... 114/298
4,057,024 11/1977 Adams ..... 114/298

FOREIGN PATENT DOCUMENTS

WO82/03830 11/1982 PCT Int'l Appl. ..... 114/294

*Primary Examiner*—Galen L. Barefoot
*Assistant Examiner*—Edwin L. Swinehart
*Attorney, Agent, or Firm*—Alfred D. Lobo

[57] ABSTRACT

A simple yet rugged and reliable collapsible anchor in an anchor assembly is disclosed for use with various small craft which are susceptible to damage by a conventional anchor stowed aboard or by the anchor being fouled when there is a swift current. The anchor is a stock anchor in which both the stock arms and the flukes are foldable alongside the anchor's hollow shank so as to be sheathed in a sheath from which the anchor is released when it is cast. A release mechanism is provided within the anchor's hollow shank which mechanism allows the anchor to be either self-tripped, or manually tripped, by exerting a pulling force of predetermined amount, which force required is adjustable; the mechanism obviates the use of shear pins. The anchor assembly is optionally protected by a cushioning means such as a resilient bumper or fender in which the sheathed anchor is removably inserted; or, a seat cushion in which the sheathed anchor is removably inserted, and thus may be stowed aboard the craft without occupying additional space.

8 Claims, 6 Drawing Figures

COLLAPSIBLE ANCHOR HAVING RELEASABLE FLUKES

BACKGROUND OF THE INVENTION

This invention relates to a portable readily deployable anchor having a collapsible stock and flukes, and the flukes are releasable if the anchor snags so as to exert a a pull on the anchor's line which pull exceeds a predetermined force. In other words, the release of the anchor is self-tripped by a release mechanism to avoid abandoning a snagged anchor; or, to ensure that small craft such as a canoe, rubber raft, small sailboat or the like is not subjected to a constraint which might damage the boat or cause it to be inundated. This is particularly true of a rubber raft which may be anchored in a swift stream.

Some anchors of this general type have used locking plugs which are to release the snagged flukes when the force on the line exceeds a certain amount, but the greater the pull on the anchor's line, the harder the flukes tend to lock against the locking plugs. To overcome this problem a stockless anchor described in U.S. Pat. No. 4,038,934 was devised, except that to release the snagged anchor, one must first pull on the line with a force greater than a preset force and then slacken the line to unlatch the flukes. It will be evident that slackening the line will not be possible when the craft is anchored in a fast moving stream.

A similar objection and operational disadvantage enures to prior art releasable anchors which require that the line be slackened before it is given a sharp, forceful tug. The requirements for a releasable anchor are particularly acute when it is required to be collapsible so that it can be easily handled and stowed in the limited space available in a small craft. More so than for a small boat, a rubber raft is particularly susceptible to damage from a pointed fluke, not to mention the obvious danger to occupants of the raft. To fill the need for collapsible anchors, numerous such anchors have been described in the prior art, for example in U.S. Pat. Nos. 3,111,106; 3,111,107; 3,485,199; 3,593,682; 3,656,448; 3,747,553; 4,094,264; 4,094,265; 4,098,217; 4,114,554; 4,380,207; 4,385,585; and 4,417,538; inter alia. None of the teachings of the patents suggested that the anchors should be sheathed, nor would there have been any operational relationship of a sheath for such anchors and their flukes, had the anchors been sheathed.

An occasion to sheath an anchor having extendable flukes presented itself in a dynamic anchor described in U.S. Pat. No. 3,187,705 which anchor was designed to descend into deep water with maximum velocity. But the teachings relating to high velocity deep water anchors are inapplicable to an anchor for a small boat or raft which typically operates in shallow water and the velocity of descent of the anchor is of no particular concern.

With particular reference to releasable anchors which are not self-tripped, that is trigger-tripped, the use of a secondary line to trip the flukes by displacing a wedge or locking plug, presents undesirable complications. Whether self-tripped or not, most such anchors have an "open" mechanism, that is, their mechanisms are not protected against silt, grit and debris which tend to lodge in the mechanism and vitiate its reliability.

The importance of providing an appropriate solution to the problem of anchoring small boats was addressed in U.S. Pat. No. 4,004,625 but an appraisal of the scope of this and other pertinent prior art, and an evaluation of the differences between the prior art and my invention indicate that its particular features unexpectedly provide it with the versatility desired in an efficient anchor without sacrificing reliability and ruggedness, and at an economical price.

SUMMARY OF THE INVENTION

It is a general object of this invention to provide a simple yet rugged and reliable collapsible anchor for small craft which are susceptible to damage by a conventional anchor stowed aboard, or by the anchor being fouled when there is a swift current.

It is also a general object of this invention to provide an anchor which is a stock anchor in which both the stock arms and the flukes are foldable alongside the anchor's hollow shank so as to be sheathed in a tube or sheath from which the anchor is released when it is cast.

It is another general object of the invention to provide a release mechanism within the hollow shank of the anchor which allows the anchor to be self-tripped, or manually tripped by exerting a pulling force of predetermined amount, which force required is adjustable; and, which mechanism obviates the use of shear pins.

It is still another general object of this invention to provide an anchor for a small craft which can be protected by a cushioning means such as a resilient bumper or fender in which the sheathed anchor is removably inserted; or, a seat cushion in which the sheathed anchor is removably inserted, and thus may be stowed aboard the craft without occupying additional space.

BRIEF DESCRIPTION OF THE DRAWINGS

The foregoing and other objects and advantages of my invention will appear more fully from the following description, made in connection with the accompanying drawings of preferred embodiments of the invention, wherein like reference characters refer to the same or similar parts throughout the several views and in which.

DETAILED DESCRIPTION OF PREFERRED EMBODIMENTS

In a preferred embodiment the anchor of this invention is specifically for use in a small water craft such as a rubber raft or small sailboat particularly if it is an inflatable boat. The need for an anchor for such craft is well recognized, but as yet, no commercially viable anchor has been available which fulfills the special needs of a person operating such a craft. As is also well recognized, such craft are operated in relatively shallow waters, often in rocky terrain. Space is at a premium and carrying an anchor inside the craft is shunned because it occupies valuable space.

Figure 1:
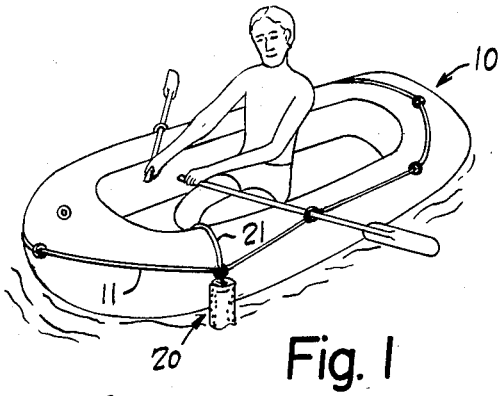
FIG. 1 is a perspective view of a rubber raft with an outboard fender in which an anchor assembly is removably disposed.

Referring to FIG. 1 there is shown a perspective view of a rubber raft 10 carrying an anchor assembly indicated generally by reference numeral 20, releasably secured by an outboard line 11 so as to function as a bumper or fender protecting the raft from damaging encounters with rocks, logs or other large objects which may be lodged in the stream. It is desirable to have several such fenders disposed around the raft, and these are typically made of a resilient natural or synthetic resinous material such as rubber or foamed polyurethane, and one or more of these fenders will have an anchor assembly disposed within it.

Figure 2:
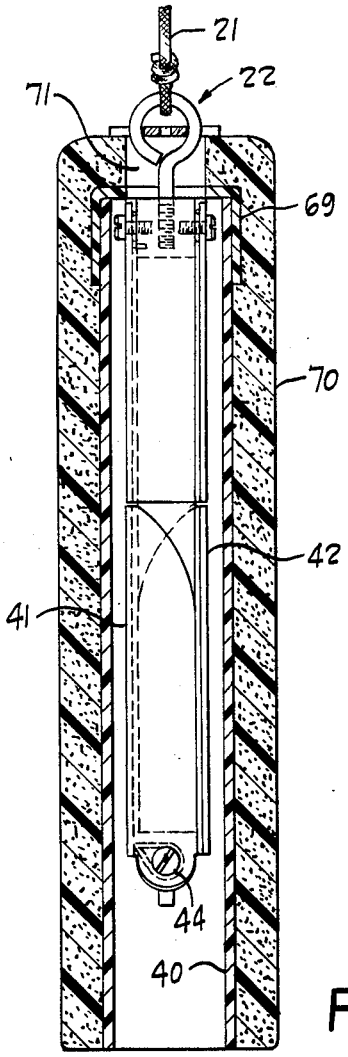
FIG. 2 is a longitudinal partial cross sectional view of the fender and sheath each made from a synthetic resinous material, in which sheath the anchor assembly comprising a tubular sheath and a collapsible (foldable) stock anchor is releasably held.

An anchor line 21 is connected to a ring member 22 at the upper end 23 of a hollow shank member ('shank') 24 illustrated as a tube having a rectangular cross section in FIG. 2. The particular configuration of the cross section is not critical and it may be cylindrical or elliptical, but a rectangular one is preferred. Referring further to FIG. 2 there is shown a pair of stock arms 25 and 26 of approximiately equal length which together provide the stock which is foldably disposed alongside the upper end of the shank and on opposite sides thereof. Each stock arm is pivotable about pivot means 30 adjacent the upper end 23 of the shank 24, and is moveable from its folded position alongside the shank to an extended operative position shown in FIG. 3. Each arm has a right angle cross section such as is typical of common angle iron, so that the inner surfaces of each arm, when folded, lie alongside adjacent outer surfaces of the shank 24. The edges at the outer ends of each stock arm are preferably rounded so as not to present any sharp corners.

It is important to note that the length of each stock arm is preferably less than one-half the length of the shank 24 for satisfactory operation of the anchor. This requirement derives from the length of each of a pair of flukes 41 and 42 which are pivotably disposed adjacent the lower end 43 of shank 24. The flukes are moveable, in a manner analogous to the movement of the stock arms, from a folded position alongside the lower end to an extended position at right angles to the shank.

Figure 3:
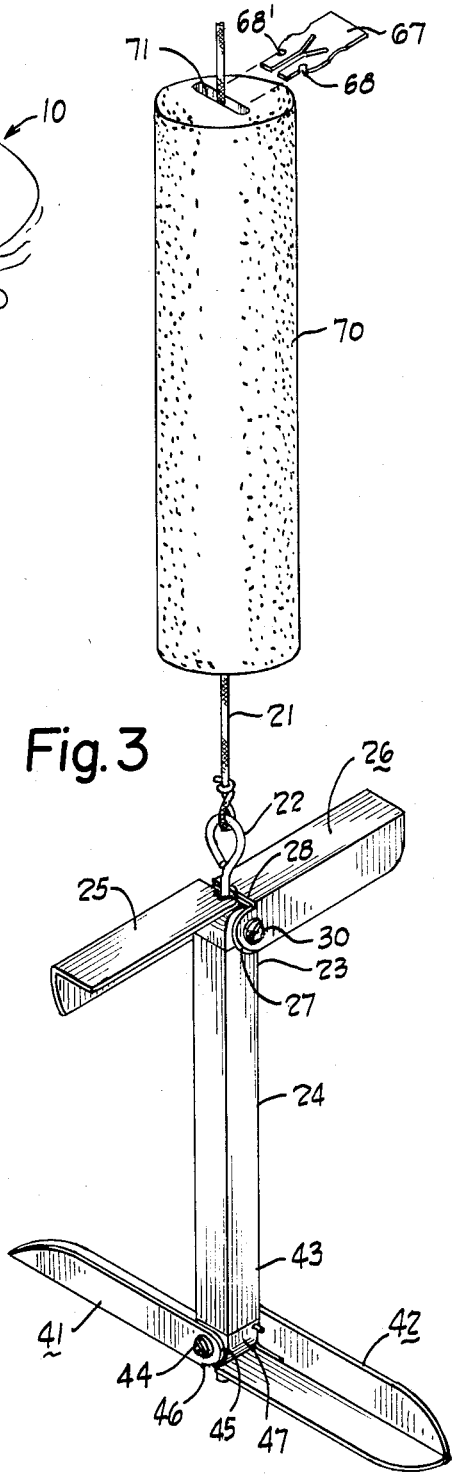
FIG. 3 is a perspective view of the anchor after it is released from its sheath showing the pair of stock arms and pair of flukes in their extended position as when the anchor is in operation.

As shown in FIG. 3, fluke 41 pivots about pin 44, and as described hereinabove, the inner end of the fluke has a portion cut away to provide a rounded ear 45 the circumference of which terminates at the fluke's inner edge 46. The lower end 43 of the shank terminates in a rounded plug 47 (lower end plug) to facilitate pivoting motion of the fluke. Each fluke is also of right angle section, and when folded, lies alongside the adjacent outer surfaces of the shank. The outer end of each fluke is preferably pointed for better purchase in the solid or semi-solid bed of the body of water. For best performance it is preferable to have each fluke about one-half the length of the shank. Fluke 42 has an inner configuration (not shown) including pivot means and stock spring analogous to that described for fluke 41, so that fluke 42 can also be folded and sheathed in the sheath 40.

Figure 4:
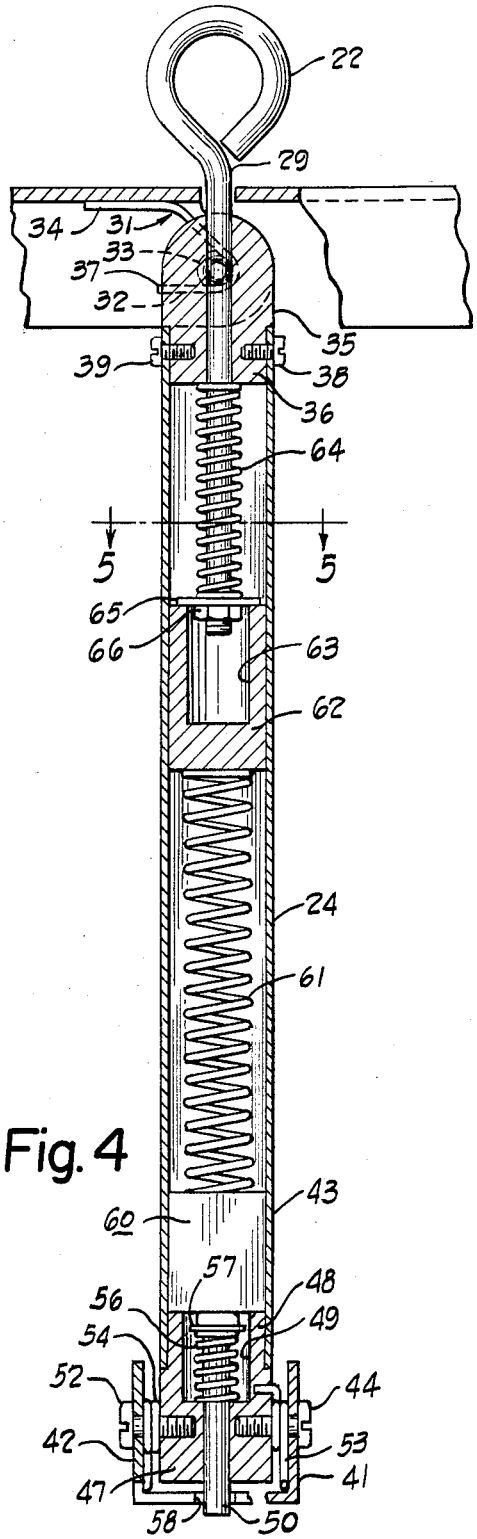
FIG. 4 is a longitudinal cross sectional view, with portions of the stock arms broken away, showing the release mechanism which is held within the hollow shank of the member.
Figure 5:
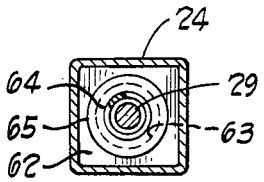
FIG. 5 is a cross sectional view along the line 5—5 in FIG. 4 showing the longitudinally axial alignment of the first spring.

As is shown in greater detail in FIGS. 3 and 4, the inner end of each stock arm 25 and 26 is relieved by cutting a part of its horizontal portion and rounding the vertical portion to provide an ear 27, the circumference of the ear terminating at the inner edge 28 of the arm. Pivot means for each arm is conveniently provided by a pin 30 through the ear 27 to allow pivoted movement of the arm 26 through an arc of about 180°.

In the extended position of the arm 26 it is locked by abutment of edge 28 against stem 29 of the ring member 22 so that the arm pivots through an arc of 90°. The stem passes through an axial bore 34 in plug 35 (upper end plug) having a rounded upper surface to provide clearance for the swinging movement of the stock arms, and a short neck portion 35 which is removably inserted snugly into the shank 24 and secured therein with screws 38 and 39. The upper end plug 35 is drilled to threadedly receive screws having shoulders which serve as the pivots 30.

An approximately U-shaped spring member ('stock spring') indicated generally by reference numeral 31 is operatively disposed so as to bias the stock arm outward into its extended position when the anchor is released, and to permit the stock arm 26 to be manually pressed downwards into its folded position and inserted in a sheath 40 when the anchor is stowed. As illustrated in FIG. 4 this is conveniently effected by locking one arm 32 in the upper end plug 35, inserting pin 30 through a loop 33 in the trough of the U-shaped spring 31, and biasing the other arm 34 of the spring against the underside of the inner end of stock arm 26. The particular configuration of the spring means is not narrowly critical and may be a resilient rubber plug with requisite compressibility, provided the spring means is associated with each stock arm to extend it into the extended position, and to permit the stock arms to be manually folded when the anchor is to be returned to its sheath. Arm 25 has an inner end configuration (not shown) including pivot means and stock spring analogous to that of the inner end of arm 26, so arm 25 can also be folded and sheathed in the sheath 40.

It is important to note that the length of each stock arm is preferably less than one-half the length of the shank 24 for satisfactory operation of the anchor. This requirement derives from the length of each of a pair of flukes 41 and 42 which are pivotably disposed adjacent the lower end 43 of shank 24. The flukes are moveable, in a manner analogous to the movement of the stock arms, from a folded position alongside the lower end to an extended position at right angles to the shank.

As shown in FIG. 3, fluke 41 pivots about pin 44, and in a manner analogous to that described hereinabove, the inner end of the fluke has a portion cut away to provide a rounded ear 45 the circumference of which terminates at the fluke's inner edge 46. The lower end 43 of the shank terminates in a plug 47 (lower end plug) having a rounded lower outer surface to facilitate pivoting motion of the flukes. The plug 47 has a neck portion 48 which is snugly removably fitted into the shank's lower end 43 and secured therein with screws (not shown). The lower end plug is drilled and tapped to threadedly receive a pair of machine screws having shoulders which serve as the pivots 51 and 52. Each fluke has a spring means associated with it which operates to extend the fluke into an extended position at right angle to the the shank, and permits the flukes to be manually folded when the anchor is to be sheathed. Spring means 51 and 52 are provided for this purpose, and are generally U-shaped springs each with a loop in its trough, similar to the springs used to operate the stock arms. One arm of each spring is biased against the inner surface of each fluke, the pivot pin (screw) is passed through the loop and the other arm is held in a slot in the lower end plug, in a manner analogous to that described hereinabove and need not be described in detail again.

Since the flukes, like the stock arms, when folded, conform to the sides of the hollow shank which in this embodiment is rectangular, each fluke is also of right angle section, and when folded, lies alongside the adjacent outer surfaces of the shank.

It will be evident that, with the foregoing requirement of foldability alongside a rectangular shank, only a pair of angled stock arms and flukes may be used. With a shank having a circular cross section several flukes may be used, each pivotally disposed as described, but it is inconvenient, unnecessary and uneconomical, not to mention that the physical dictates of a small anchor would require that multiple flukes be each quite narrow. Narrow flukes of the same material, preferably aluminum or stainless steel, are weaker than wider ones of the same length. For best performance it is preferable to have each fluke about one-half the length of the shank, or more. Fluke 42 has an inner configuration (not shown) including pivot means and stock spring analogous to that described for fluke 41, so that fluke 42 can also be folded and sheathed in the sheath 40.

The neck 48 has a central stepped bore having an enlarged portion 49 which is stepped down, short of the threaded recesses for the pivot pins 44 and 52, into a smaller bore 55 which extends through the plug 47. A release pin 50 is inserted through an axially compressible first resilient means such as a relatively weak coil spring 56 (release pin spring) and a washer 57 so that, when the spring 56 is sufficiently compressed (as shown) by an incompressible block 60, the pin extends through the plug 47 and past the flukes 41 and 42 in their extended position through a half-circular throughbore 58 in the edge of each fluke. When the anchor is in operation, each fluke thus bears against the protruding end of the release pin which thus functions as a retractable locking pin, which locks the flukes. The release pin spring, when compressed, exerts a relatively small force in the range from about 10–20 lb.

Though the block 60 is biased against the head of the release pin, it also rests on the upper surface of the neck 48 which prevents the block from being cocked in the shank. The block 60 is thus longitudinally axially displaceable within lower end 43. The block 60, in turn, is biased by a second resilient means such as a central coil spring 61 thrust against the upper surface of the block. The central spring 61 is relatively stiff, exerting a relatively large force in the range of from about 40–60 lb when compressed about 0.25 in. The central spring 61 also biases, with its upper end, an incompressible block 62 having a central recess 63, which block is also longitudinally axially displaceable within the shank 24.

The stem 29 of the ring member is inserted through a third resilient means such as a coil spring 64 (ring spring) and through a thrust washer 65, and has a nut 66 threadedly securing the washer and spring so that it is compressed against the neck 36 of the plug 35. The ring spring is stiffer than the central spring, exerting an even larger force in the range from about 50–70 lb when compressed about 0.5 in.

It will be evident that the block 62 may be dispensed with if the thrust washer bears directly on the upper surface of central spring 61. However, the alignment of the springs in the hollow shank is best maintained by using the block 61. The loading of the springs, thus, the predetermined force required to release the flukes can be increased by removing the upper end plug 35, and compressing the ring spring 64 by advancing the nut 66 on the stem 29. A wider range of adjustments is effected by substituting the ring spring and central spring, provided that at all times, the force required to compress the ring spring sufficiently to release the flukes is greater than the force exerted by the central spring 61.

It will now also be evident that the anchor assembly comprises an elongated tubular sheath 40, and a collapsible, self-tripped anchor sheathed for storage in the sheath when not in use. It is held in the sheath by a keeper means adapted to fit around the stem 29 of the ring member 22 when it is inserted through a cap 69 of the sheath. It is preferred, in one embodiment, to removably insert the anchor assembly into a cushion means such as a hollow resilient natural or synthetic resinous cylindrical member which serves as a fender (or bumper). If this is done, fender 70 is provided with an upper passage 71 through which the ring 22 is inserted and held in place with a slotted keeper 67, as shown.

In another embodiment, the anchor assembly may be analogously inserted in a rectangular parallelpiped of resilient material and similarly held therein with a keeper, and the parallelpiped may then be used as a seat cushion in the small craft carrying the cushion. The only difference between the fender (sheath) embodiment and the seat cushion sheath is the shape of the cushion which shape is arbitrarily chosen for utilitarian comfort and need not be illustrated in a drawing.

When the anchor is to be cast, it is removed from the fender by removing the keeper 67, and the sheath is held in the hand while the anchor is ejected from it with a sharp throwing motion of the arm. The sheath and fender are thrown in the water and the fender floats while the anchor's line is payed out through the sheath and fender until the anchor is lodged underwater. Under normal circumstances, the anchor may be retrieved by simply raising it with the anchor's line, folding the stock arms and flukes, inserting the anchor into the sheath and in turn inserting the sheath into the fender.

However, should the craft be anchored in a swift stream, and a sudden increase in velocity of the stream occurs which exerts a pull greater than a predetermined amount deemed safe for the craft, the anchor is self-tripped and the craft is freed.

Figure 6:
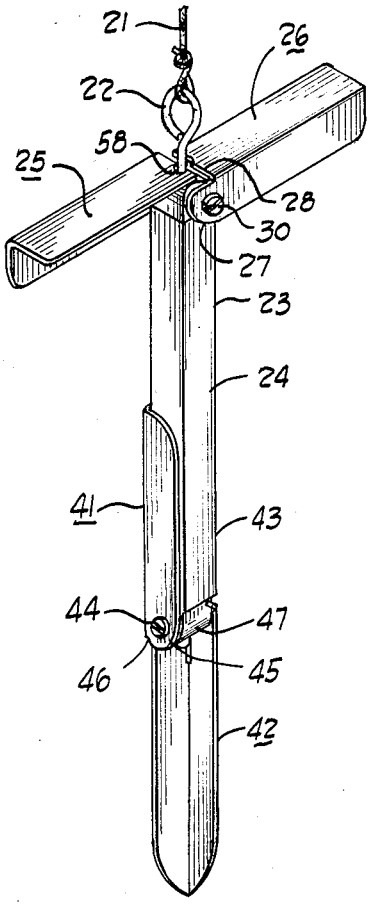
FIG. 6 is a perspective view of the lower portion of the anchor after it is tripped so as to release the flukes causing them to be generally longitudinally aligned adjacent the shank.

The self-tripping action of the anchor is actuated by a release mechanism protectively housed within the anchor's shank. This release mechanism comprises three spring means aligned longitudinally axially within the shank, including a first spring means (ring spring $S_1$) biasing a second spring means (central spring $S_2$) against the longitudinally axially displaceable block, and a third spring means (release pin spring $S_3$) associated for operation with the release pin protruding from the lower end of the shank and biasing the block so as to exert a force less than that exerted by either $S_1$ or $S_2$. The flukes are released when a predetermined force is exerted on the line to compress spring $S_1$ sufficiently to displace the block 60 axially upwardly within the shank and release the flukes which are then aligned in a generally parallel relationship with the shank, as shown in FIG. 6. It will be evident that the flukes will not be released if an equal force is exerted on the release pin by each of the flukes.

Since the anchor is not likely to be lodged so that this circumstance may arise, there is no difficulty in releasing the flukes. It will also be evident that, if the anchor is fouled and is to be manually freed, the release pin may be withdrawn into the shank by exerting a force on the anchor's line sufficient to compress spring $S_1$ enough so that spring $S_2$ follows it, biased by the block 60 which in turn follows $S_2$, allowing expansion of spring $S_3$ and retracting the release pin, thus releasing the flukes.

The release mechanism, apart from the anchor, may be used for releasing a member which is abuttingly locked against the release pin, near the end thereof which protrudes from the outer surface of a tubular shank in which the mechanism is housed, the release pin being orthogonally disposed relative to the member, the mechanism including the tubular shank having an upper end and a lower end in which shank is protectively housed the release mechanism including three spring means aligned longitudinally axially within said shank; a first spring means $S_1$ biasing a second spring means $S_2$ against a longitudinally axially displaceable block, and a third spring means $S_3$ associated with the end of the release pin and biasing the block so as to exert a force less than that exerted by either spring $S_1$ or spring $S_2$.

Such a release mechanism may be used, preferably in conjunction with others which are suitably placed, to drop open a gate on the bottom of a railroad car carrying coal which is to be dumped.

I claim:

1. An anchor assembly for small boats, rubber rafts and like craft which are susceptible to damage, or are endangered by a too-great constraint exerted by the anchor's line due to fouling of the anchor, said anchor assembly comprising, (A) an elongated tubular sheath, and (B) a collapsible, self-tripped anchor sheathed for storage in said sheath when not in use and manually releasable from the sheath when the craft is to be anchored when the anchor is cast, by attachment to the line which passes through the sheath, said anchor comprising, (a) a tubular shank having an upper end and a lower end in which shank is protectively housed a release mechanism including three spring means aligned longitudinally axially within said shank, a first spring means $S_1$ biasing a second spring means $S_2$ against a longitudinally axially displaceable block, and a third spring means $S_3$ biased against a release pin protruding from the lower end of said shank and said release pin biased against said block so that said third spring means $S_3$ exerts a compressive force against said release pin less than that exerted by either $S_1$ or $S_2$;

(b) a stock foldably disposed alongside the upper end of the shank and on opposite sides thereof, said stock comprising a pair of oppositely disposed stock arms pivotable about pivot means adjacent the upper end of the shank and moveable from a folded position alongside the upper portion of the shank to an extended position after the anchor is unsheathed; and, (c) a pair of oppositely disposed flukes pivotably mounted adjacent the lower end of the shank, said flukes being moveable from a folded position alongside the lower end to an extended position with the inner ends of the flukes locked against the protruding release pin;

whereby said flukes are released when a predetermined force is exerted on the like to compress spring $S_1$ sufficiently to displace said block axially upwardly within the shank without exerting a tension on said third spring means $S_3$ so as to release the flukes which are then aligned in a generally parallel relationship with the shank.

2. The anchor assembly of claim 1 wherein said sheath is slideably removably inserted within a resilient cushioning means.

3. The anchor assembly of claim 2 wherein said cushioning means is a foamed synthetic resinous material having a bulk density less than that of water so that the cushioning means may float on the water when the anchor is deployed.

4. The anchor assembly of claim 3 wherein said cushioning means is a generally cylindrical body hung from the side of said craft to serve as a fender.

5. The sheathed anchor of claim 3 wherein said cushioning means is a generally rectangular body placed within said craft to serve as a seat.

6. The anchor of claim 1 wherein said attachment means includes a ring member having a stem with a threaded end disposed longitudinally axially within spring means $S_1$ which is held between the inner surface of said upper end of the tubular shank and a thrust washer, the compression of $S_1$ being adjustable by a nut threadedly disposed on said stem.

7. The anchor of claim 6 wherein said release mechanism includes a plug slideably disposed within said shaft, said plug having a central plug cavity adapted to receive said nut, the plug's upper surface bearing against the lower surface of said thrust washer, and the plug's lower surface bearing against the upper end of spring $S_2$.

8. The anchor of claim 7 wherein said release pin is longitudinally axially disposed within said spring $S_3$ which is biased against a collar means near the upper end of said pin, said collar means having a diameter adapted to be slideably longitudinally moveable within a pin cavity in said lower end of the shank, the upper end of the release pin being biased against the surface of said block.

* * * * *